US006948261B1

(12) United States Patent
Grasso

(10) Patent No.: US 6,948,261 B1
(45) Date of Patent: Sep. 27, 2005

(54) SUPPLEMENTAL REMOVABLE OUTERSOLE FOR FOOTWEAR

(76) Inventor: Stephanie Grasso, 2689 Mattox Creek Dr., Oakton, VA (US) 22124

( * ) Notice: Subject to any disclaimer, the term of this patent is extended or adjusted under 35 U.S.C. 154(b) by 396 days.

(21) Appl. No.: 09/892,527

(22) Filed: Jun. 28, 2001

(51) Int. Cl.[7] ..... A43B 3/12; A43B 5/00

(52) U.S. Cl. ..... 36/15; 36/100; 36/7.1 R; 36/127

(58) Field of Search ..... 36/7.3, 7.1 R, 36/7.5, 7.6, 100, 101, 15, 127

(56) References Cited

U.S. PATENT DOCUMENTS

| | | | | | |
|---|---|---|---|---|---|
| 504,660 | A | | 9/1893 | Blandy | |
| 1,596,600 | A | * | 8/1926 | Dickson | 36/134 |
| 1,684,676 | A | * | 9/1928 | Lorenzi et al | 36/30 R |
| 1,749,351 | A | | 3/1930 | McQueen | |
| 1,841,710 | A | * | 1/1932 | Byrne et al. | 36/127 |
| D105,159 | S | * | 6/1937 | Wilcox | |
| 2,233,250 | A | | 2/1941 | Easton | |
| 2,368,960 | A | | 2/1945 | Anson | |
| 2,528,951 | A | | 11/1950 | Epsztejn | |
| 2,911,738 | A | * | 11/1959 | Clerke | 36/134 |
| 3,009,269 | A | * | 11/1961 | Folk | 36/7.5 |
| 3,019,533 | A | * | 2/1962 | Smith | 36/7.6 |
| 3,313,047 | A | * | 4/1967 | Svien | 36/135 |
| 3,318,026 | A | | 5/1967 | Antelo | |
| 3,538,628 | A | | 11/1970 | Einstein | |
| 3,643,352 | A | * | 2/1972 | Adair | 36/7.3 |
| 3,982,336 | A | | 9/1976 | Herro | 36/62 |
| 4,183,157 | A | * | 1/1980 | Counselman | 36/135 |
| 4,214,384 | A | | 7/1980 | Gonzalez | 36/42 |
| 4,299,037 | A | * | 11/1981 | Carey | 36/62 |
| 4,327,503 | A | * | 5/1982 | Johnson | 36/32 R |
| 4,363,177 | A | | 12/1982 | Boros | 36/101 |
| 4,377,042 | A | * | 3/1983 | Bauer | 36/101 |
| 4,525,939 | A | * | 7/1985 | McNeil et al. | 36/114 |
| 4,779,360 | A | * | 10/1988 | Bible | 36/59 R |
| 4,807,372 | A | | 2/1989 | McCall | 36/135 |
| 4,936,028 | A | | 6/1990 | Posacki | 36/15 |
| 5,269,080 | A | | 12/1993 | Davis | 36/134 |
| 5,315,767 | A | * | 5/1994 | Bradbury | 36/7.1 R |
| 5,419,060 | A | | 5/1995 | Choi | 36/36 |
| 5,497,565 | A | | 3/1996 | Balgin | 36/61 |
| 5,600,902 | A | * | 2/1997 | Yavitz | 36/135 |
| 5,615,495 | A | * | 4/1997 | Mastrocola | 36/2.6 |
| 5,644,857 | A | | 7/1997 | Ouellette et al. | 36/15 |
| 5,661,915 | A | * | 9/1997 | Smith | 36/101 |
| 5,813,143 | A | * | 9/1998 | Bell et al. | 36/59 R |
| 5,836,090 | A | * | 11/1998 | Smith | 36/11.5 |
| 5,921,005 | A | * | 7/1999 | Bell et al. | 36/11.5 |
| 6,032,386 | A | * | 3/2000 | Evans | 36/15 |

* cited by examiner

*Primary Examiner*—M. D. Patterson

(57) ABSTRACT

A removable outersole covering for the treaded bottom of an athletic footcovering is provided in one embodiment of the present invention. In this embodiment the outersole includes an elastically deformable band defining a continuous loop, the band having a top edge and a bottom edge, the bottom edge of the band forming the shape of the border of the treaded bottom of the athletic footcovering, a sole surface coupled to the bottom edge of the band, the sole surface configured in the shape of the treaded bottom of the athletic footcovering; and a plurality of sport cleats protruding from the bottom side of the sole surface.

18 Claims, 4 Drawing Sheets

SUPPLEMENTAL REMOVABLE OUTERSOLE FOR FOOTWEAR

TECHNICAL FIELD

The present invention regards a supplemental removable outersole for footwear. More particularly the present invention regards a supplemental removable outersole having athletic spikes or grips that can be releasably secured to the sole of footwear for athletic use.

BACKGROUND

Cleated or spiked athletic shoes often have their spikes or cleats secured to a rigid flat sole. These rigid soles impart at least two functions. They provide an outside surface for the spikes or cleats to be mounted to and they provide a foundation for the construction of the upper portions of the shoe. The outside surface of the sole, exposed to the outside environment, is typically an uncovered and exposed rigid plastic designed to withstand external impacts. Comparatively, the inside surface of the sole, in contact with an athlete's foot, is typically covered with a layer of cloth or other material to provide a degree of cushioning. Despite this covering, however, the inside surface of the rigid flat sole may irritate or otherwise injure the foot of the wearer. For athletes, who wear these athletic shoes over prolonged periods of time, their feet may rub against the unyielding rigid inside surface, grazing their feet and leading to the formation of calluses and blisters. In addition, the flat bottoms can promote premature foot fatigue and flatten the wearer's foot due to the lack of arch support. Moreover, in younger athletes, whose feet are still developing, the problem is even more troublesome as the lack of support may not only irritate and fatigue the athletes foot but may also lead to irreparable injuries of their feet.

SUMMARY OF THE INVENTION

The present invention is directed to supplemental removable outersoles for athletic footwear. In one embodiment of the present invention, a removable outersole covering for the treaded bottom of athletic footwear is provided. In this embodiment the outersole includes: an elastically deformable band defining a continuous loop, the band having a top edge and a bottom edge, the bottom edge of the band forming the shape of the perimeter of the treaded bottom of the athletic footcovering, a sole surface coupled to the bottom edge of the band, the sole surface configured in the shape of the treaded bottom of the athletic footcovering; and a plurality of sport cleats protruding from the bottom side of the sole surface.

In another embodiment of the present invention athletic footwear having a top surface is provided. This footwear may include a permanent sole; a removable outersole covering the permanent sole; a plurality of sport cleats protruding from the removable outersole; and an elastically deformable band secured to the entire perimeter of the removable outersole, the elastically deformable band sized to removably secure the removable outersole to the permanent sole.

DETAILED DESCRIPTION

Figure 1:
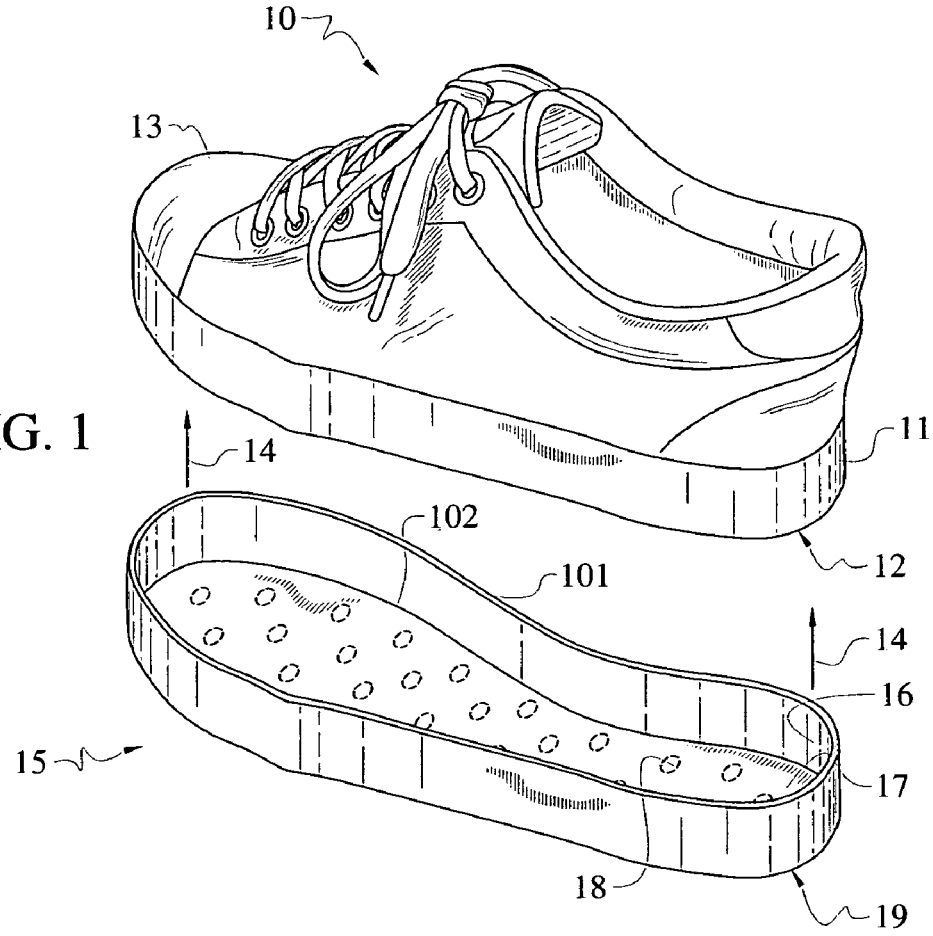
FIG. 1 is a rear side isometric view of an athletic footcovering and removable supplementary outersole in accord with an embodiment of the present invention.

FIG. 1 is a side isometric view of athletic footwear or footcovering 10 and a supplementary removable outersole 15 in accord with an embodiment of the present invention. The athletic footcovering 10 in this embodiment has a toe cap 13, a bottom tread 12, and a side molding 11, all made from injected rubber. These components may also be made from polyvinyl chloride and certain durable foams, while the toe cap may also be made from canvas. Moreover, other materials may also be used to manufacture these components.

The removable supplementary outersole 15 in this embodiment has a sole plate 17 with a bottom surface 19 having cleats 18 screwed to it. The supplementary outersole 15 also has a side elastic border 16 with a top edge 101 and a bottom edge 102, the bottom edge 102 being glued to the plate 17. The plate 17 in this embodiment has been made from a rigid plastic while the elastic border has been made from rubber. The removable supplementary outersole 15 has been sized to fit underneath and elastically secure itself to the bottom of the athletic footcovering 10.

In use the removable supplementary outersole 15 may be placed beneath the athletic footcovering 10 as shown by arrows 14. The elastic border may then be stretched while the bottom tread 12 of the athletic footcovering 10 is slid towards and comes in contact with the top surface of the plate 17. Once the tread 12 has been firmly placed against the top surface of the plate 17 the elastic border may be released and the athletic footcovering and removable outersole combination is ready for use. By adding the supplementary removable outersole 15 to the athletic footcovering 10, the athletic footcovering may now be worn as a cleated shoe. Thus, the athletic footcovering may be worn either with or without the removable outersole 15. When the outersole 15 is not on the athletic footcovering the athletic footcovering may be used for day to day activities and when the removable outersole 15 is added to the athletic footcovering 10 it may be used for athletic competitions requiring spikes of cleats such as soccer, golf, and football. The treaded bottom of the athletic footcovering allows the shoe to also be worn without the outersole 15. This treaded surface may include rubber, foam and other surfaces and may be both patterned and unpatterned.

The plate 17 is sized for the specific athletic footcovering 10 in this embodiment although it may be sized to cover a variety of athletic footcoverings, the sizes changing in both configuration and in foot size. The outersole 15 may be sized to fit multiple configurations by increasing the height of the elastic border or otherwise adjusting its configuration to conform to a wider variety of athletic footcoverings including both sneakers and sandals as well as other types of athletic footwear.

Figure 2:
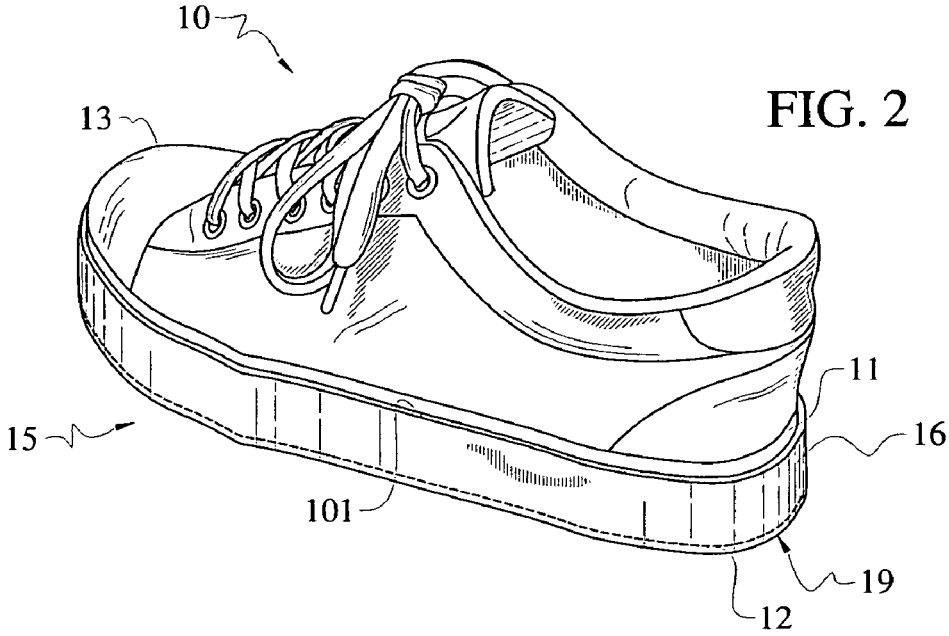
FIG. 2 is a rear side isometric view of the athletic footcovering and removable supplementary outersole from FIG. 1 after the supplementary outersole has been secured to the athletic shoe.

FIG. 2 is a side isometric view of the athletic footcovering 10 and the supplementary removable outersole 15 after they have been combined in accord with an embodiment of the present invention. As can be seen in FIG. 2 the top edge 101 of the elastic border 16 does not extend past the top rim of the side molding 11 of the athletic footcovering 10. It is preferred in this embodiment to push the tread 12 into the outersole 15 until it come in contact with the top surface of the plate 17 which is hidden behind the elastic border and beneath the treads 12.

Figure 3:
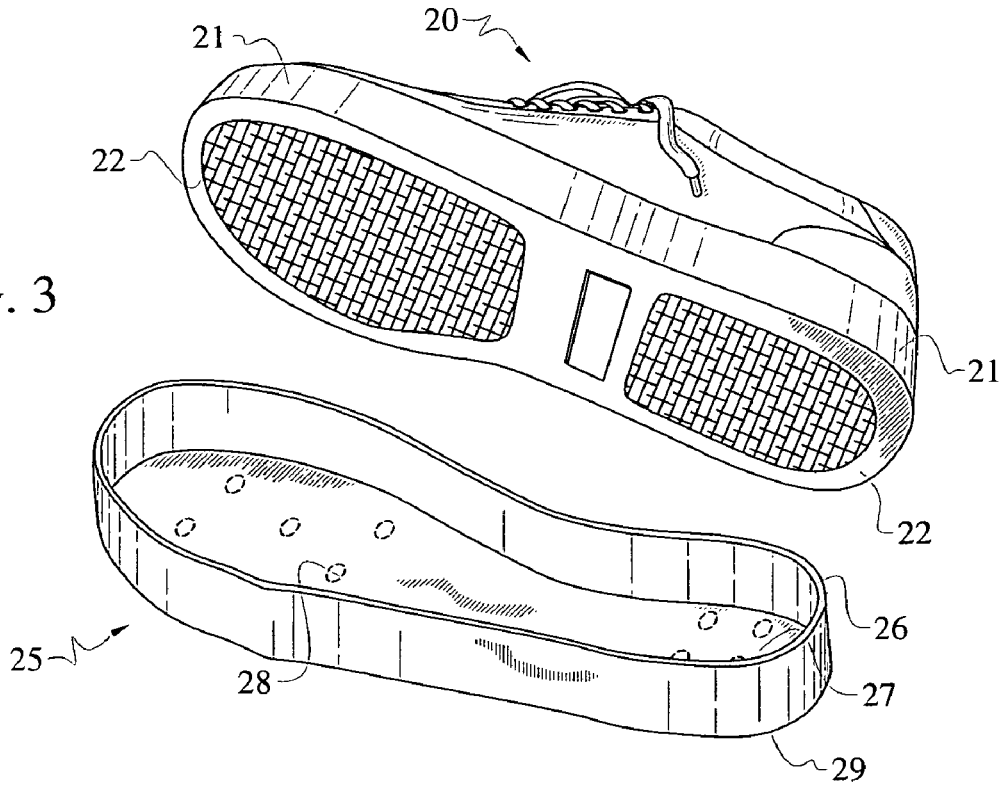
FIG. 3 is a rear side isometric view of a removable supplementary outersole and a rear bottom isometric view of an athletic footcovering in accord with an alternative embodiment of the present invention.

FIG. 3 is a bottom isometric view of an athletic footcovering 20 and a top isometric view of a supplementary removable outersole 25 in accord with an alternative embodiment of the present invention. Evident in FIG. 3 is the side molding 21, the treads 22, the cleats 28, the elastic border 26, the top surface of the plate 27 and the bottom surface of the plate 29.

Figure 4:
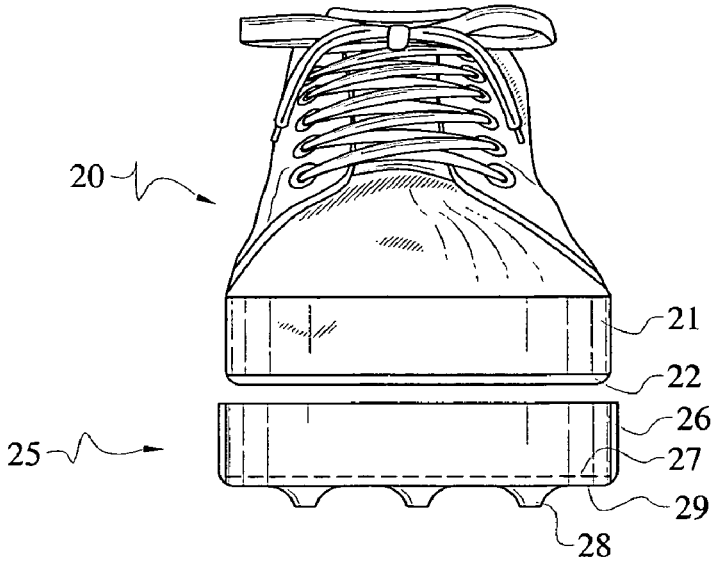
FIG. 4 is a front plan view of the athletic shoe and removable supplementary outersole of FIG. 3.

FIG. 4 is a front elevation of the athletic footcovering 20 and removable outersole 25 of FIG. 3. The profile of the cleats 28 is clearly evident in this view. Also evident are the side molding, the treads 22, the elastic border, and the top surface of the plate 27.

Depending upon the desired sport, the cleats located underneath the plate may be removed and substituted for metal spikes, soft spikes of any other gripping system that may be appropriate for the sport to be played.

Moreover, while an athletic footcovering has been described in the above embodiments a low-heeled shoe may instead be used with the removable outersole being tiered to accommodate the heel. The removable outersole may, in this embodiment, contain soft spikes. Thus, in this embodiment, the removable outersole my convert an ordinary street shoe into a shoe suitable for golf.

Figure 5:
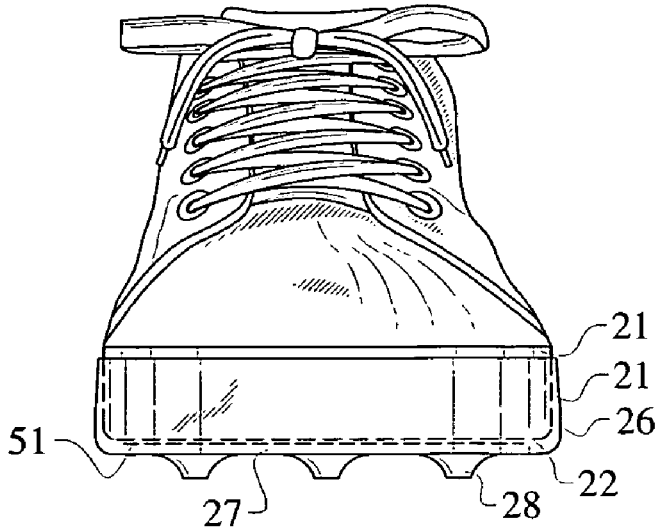
FIG. 5 is a rear plan view of the athletic footcovering and the removable supplementary outersole of FIG. 3.

FIG. 5 is a rear elevation of the athletic footcovering 20 and removable outersole 25 of FIG. 3. As is evident in this view, the elastic border 26 has a tapered cross-section. Also evident in this view is that the threads 22 rest against the top surface 51 of the plate 27 in this embodiment and that the elastic border may be the sole means for attaching the outersole 25 to the footcovering 20.

Figure 6:
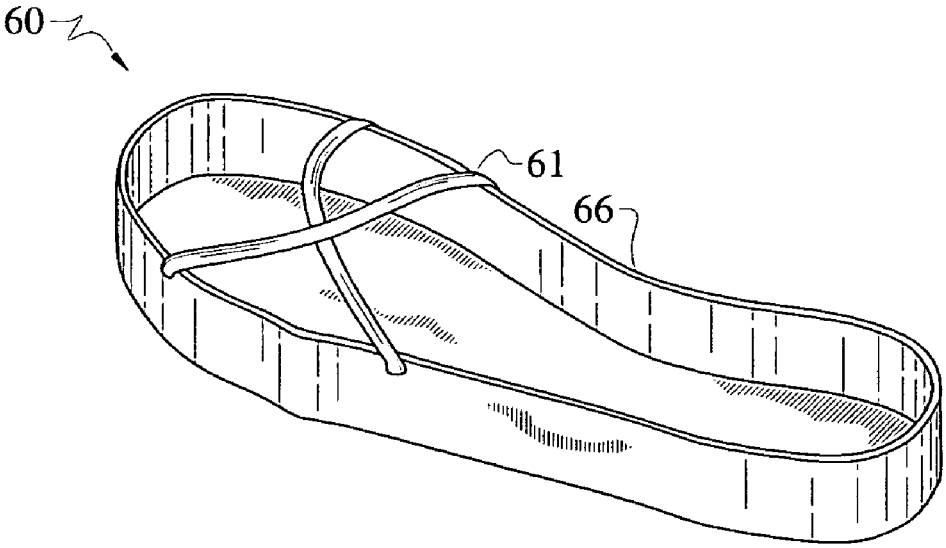
FIG. 6 is an isometric top view of a removable supplementary outersole in accord with another alternative embodiment of the present invention.

FIG. 6 is a top isometric view of a supplementary removable outersole 60 in accord with another alternative embodiment of the present invention. The cross straps 61, anchored to the elastic border 66 is clearly evident. These straps 61 may be employed in this embodiment to further secure the outersole 60 to a shoe. The straps 61 may be made from any elastic material and may be glued to side of the border 66 or may be releasably secured to the elastic border through a snap or other securement means. Moreover, the straps 61 illustrated in FIG. 6 may also be laces 61 or other securement means that may be used to supplement the attachment of the removable outersole 60 to a shoe (which is not shown).

Figure 7:
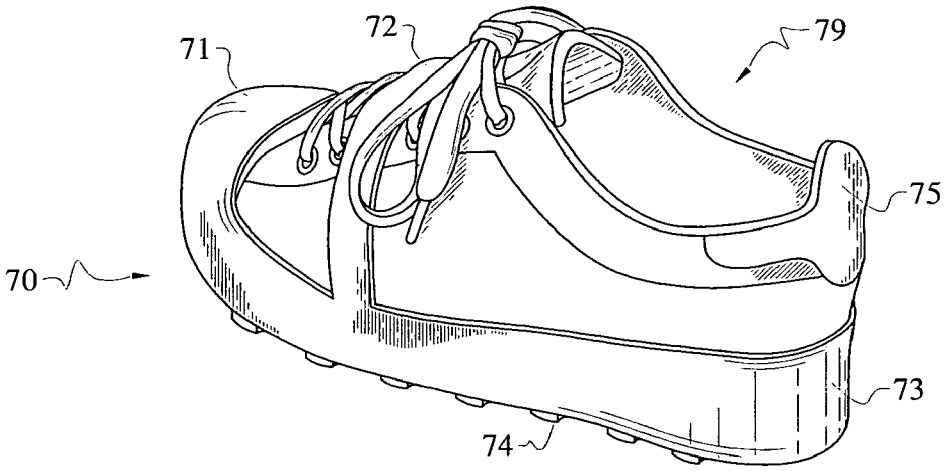
FIG. 7 is an isometric top view of a removable supplementary outersole mounted on an athletic footcovering in accord with another alternative embodiment of the present invention.

FIG. 7 is a rear side isometric view of another alternative embodiment of the present invention. In this embodiment the supplemental releasable outersole 70 is further secured to the athletic footcovering 79 with a toe cap 71 in addition to the strap 72. The toe cap 71 working in conjunction with the strap 72 can be configured in innumerable configurations to help secure the releasable outersole 70 to the athletic footcovering 79. The toe cap is advantageous because it can facilitate the securement of the outersole 70 to several lengths of shoe. The toe cap 71 and the strap 72 may be formed in conjunction with the rest of the releasable outersole 70 or alternatively the toe cap 71 and the strap may be formed separately from the outersole 70 and may later be secured to the shoe with snaps or some other fastening means.

Also evident in FIG. 7 are the elastic border 73 and the turf knobs 74. As can be seen the elastic border is taller in this embodiment than in the previous embodiments and completely covers the lower portion of the athletic footcovering. In addition, rather than having the spikes or cleats of the previous embodiments the removable sole 70 in this embodiment contains a plurality of knobs 74 protruding from its lower surface. These knobs are preferably formed as surface protrusions during the manufacturing of the removable outersole 70.

A supplemental removable outersole for athletic footwear has been provided. While various embodiments have been presented above other embodiments are also plausible without straying from the spirit or scope of the present invention.

What is claimed is:

1. A removable cleated outersole system comprising:

an athletic foot covering having a permanent substantially planar treaded bottom, the treaded bottom having a toe portion, a heel portion, a perimeter side surface, the perimeter side surface defining the perimeter shape of the permanent treaded bottom of the athletic foot covering;

a single elastically deformable band creating a continuous unbroken loop, the band having an unbroken and continuous top edge and a bottom edge, the bottom edge of the band being unbroken and formed in the shape of the perimeter shape of the permanent treaded bottom of the athletic foot covering;

a substantially planar unbroken sole surface coupled to the bottom edge of the band, the sole surface configured in the same perimeter shape and size of the permanent treaded bottom of the athletic foot covering, the sole surface sized to extend between the toe portion and the heel portion of the athletic foot covering, the sole surface having a bottom side; and a plurality of sport cleats protruding from the bottom side of the sole surface.

2. The removable cleated outersole system of claim 1 further comprising:

an anchoring strap having a first end and a second end, the first end connected to the elastically deformable band, the second end connected to the elastically deformable band, the sole surface having a toe cap sized to cover the toe portion of the athletic foot covering; and a rigid substantially planar continues and unbroken sole plate coupled to and supporting the sole surface, the sole plate formed in the same shape as the sole surface.

3. The removable cleated outersole system of claim 2 wherein the anchoring strap is releasably connected to the deformable band and wherein the plurality of sport cleats are turf knobs formed as part of the bottom side of the sole surface of the removable cleated outersole and wherein the sole plate is formed in the same size as the sole surface.

4. The removable cleated outersole system of claim 1 wherein the elastically deformable band has a tapered cross-section, is made with spandex rubber and is the sole means for attaching the outersole to the athletic foot covering and the sole surface containing a sole plate, the sole plate having an exposed top surface, the sole plate being rigid, continuous, unbroken, and sized to the same dimensions as the substantially flat treaded bottom of the athletic foot covering.

5. The removable cleated outersole system of claim 1 wherein the sole surface includes a rigid sole plate, the rigid sole plate being continuous and unbroken and sized to have the same perimeter shape and dimensions as the treaded bottom of the athletic foot covering.

6. The removable cleated outersole system of claim 5 wherein the sport cleats are one of a soccer cleat, a rugby cleat, a baseball spike, a football spike, and a track sprinter's spike.

7. The removable cleated outersole system of claim 5 wherein the sport cleats are in the shape of a truncated cone with conical sides and have at least two different heights relative to one another when measured from a bottom of the sole surface, the heights of the sport cleats closer to the perimeter of the sole surface being relatively taller than the heights of the sport cleats near a center of the sole surface.

8. An athletic footwear system comprising:

a sneaker with a heel portion and a toe portion, the sneaker having a permanent continuous treaded external sole with an outside perimeter edge, the permanent treaded external sole being substantially planar;

a removable outersole having a single rigid planar unhinged sole plate, the sole plate being the same size and dimension as the permanent treaded external sole of the sneaker, the sole plate being uncovered, the removable outersole covering the external sole and the sole plate being in direct contact with the treaded external sole of the sneaker, the permanent treaded external sole of the sneaker adapted for use without the removable outersole, a plurality of sport cleats protruding from the removable outersole; and, a single unbroken continuous elastically deformable band secured to the entire perimeter of the removable outersole, the elastically deformable band sized to removably secure the removable outersole to the permanent treaded sole.

9. The athletic footwear of claim 8 further comprising:

a support band attached to the elastically deformable band, the support band sized to stretch across a top surface of the athletic footwear, the elastically deformable band secured to the perimeter of the removable outersole.

10. The athletic footwear of claim 8 wherein the sport cleats are of at least two different relative heights to each other.

11. The athletic footwear of claim 8 wherein the removable rigid planar sole plate is directly coupled to the elastically deformable band, the elastically deformable band also defining a toe cap sized to fit over the toe portion of the sneaker, the elastically deformable band also having a tapered cross-section ending in a point.

12. A method of securing turf knobs to an athletic foot covering, the athletic foot covering being spikeless, having bottom treads, and a top, the method comprising:

stretching an elastically deformable unbroken and continuous band around the perimeter of the bottom treads of the athletic foot covering, the elastically deformable band being shaped in the perimeter outline of the bottom treads of the athletic foot covering, the elastically deformable band having an outersole secured to it, the outersole having a top surface and a bottom surface, the outersole having a plurality of turf knobs protruding from it the turf knobs being integrally formed on the bottom surface of the outersole and having at least two different heights when measured from the bottom surface; and releasing the elastically deformable band.

13. The method of claim 12 further comprising:

lacing a support band over the top of the athletic foot covering, the support band in structural communication with the elastically deformable band.

14. The method of claim 12 wherein the support band is removably coupled to the elastically deformable band.

15. The method of claim 12 further comprising:

stretching a toe cap connected to the elastically deformable band over the top of the athletic foot covering.

16. The method of claim 12 wherein the outersole includes a substantially flat and rigid sole plate spanning an arch support of the foot covering, the rigid sole plate being in the same dimension and size as the perimeter of the bottom treads of the athletic foot covering.

17. The method of claim 12 wherein the turf knobs are in the shape of a truncated cone having inwardly bowed sidewalls and have at least two different heights relative to one another.

18. The method of claim 12 wherein the entire top surface of the outersole is substantially flat and is in direct contact with treads from the foot covering.

* * * * *